United States Patent [19]

Fukuizumi et al.

[11] Patent Number: 4,718,952

[45] Date of Patent: Jan. 12, 1988

[54] PROCESS FOR PRODUCING A REMELTED AND CHILLED CAMSHAFT

[75] Inventors: Toshiharu Fukuizumi; Hideo Nonoyama, both of Toyota, Japan

[73] Assignee: Toyota Jidosha Kabushiki Kaisha, Toyota, Japan

[21] Appl. No.: 894,830

[22] Filed: Aug. 8, 1986

[30] Foreign Application Priority Data

Aug. 9, 1985 [JP] Japan ..... 60-174334

[51] Int. Cl.[4] ..... C21D 9/30

[52] U.S. Cl. ..... 148/152; 148/902; 148/904

[58] Field of Search ..... 148/902, 904, 151, 152, 148/150, 4, 145; 219/121 PA, 121 PB; 266/261

[56] References Cited

U.S. PATENT DOCUMENTS

| | | | |
|---|---|---|---|
| 2,665,126 | 1/1954 | Roehm | 148/151 |
| 4,147,335 | 5/1979 | Heck | 266/261 |
| 4,312,685 | 1/1982 | Riedl | 148/151 |

FOREIGN PATENT DOCUMENTS

| | | |
|---|---|---|
| 53-94209 | 8/1978 | Japan . |
| 57-177926 | 11/1982 | Japan . |
| 59-23156 | 2/1984 | Japan . |
| 60-234168 | 11/1985 | Japan . |
| 60-234169 | 11/1985 | Japan . |

*Primary Examiner*—L. Dewayne Rutledge
*Assistant Examiner*—S. Kastler
*Attorney, Agent, or Firm*—Oblon, Fisher, Spivak, McClelland & Maier

[57] ABSTRACT

A process for producing a remelted and chilled camshaft comprises the steps of melting a sliding cam surface by TIG arc and forming a chill layer by self-cooling. When two adjacent cams are in positions at which a mutual influence from the magnetic arc blow of the TIG arc current applied to the cams can be felt, a melting current applied to two arc torches is alternately changed so that the sliding cam surface of one cam is melted while the other cam is in the nonmelted state.

2 Claims, 4 Drawing Figures

PROCESS FOR PRODUCING A REMELTED AND CHILLED CAMSHAFT

BACKGROUND OF THE INVENTION

1. Field of the Invention

The present invention relates to a process for producing a camshaft with cams. More particularly, the present invention relates to a process for producing a remelted and chilled camshaft (a surface remelted chilled layer camshaft) by melting a sliding cam surface by TIG arc and forming a chill layer by self-cooling.

2. Description of the Related Art

In a camshaft with cams fitted into an engine for an automobile and the like, an sliding cam surface of each of the cams must have a superior wear-resistance. Accordingly, the cam is subjected to a surface hardening heat-treatment in which the sliding cam surface portion is melted by a high density energy, such as a TIG arc, a laser beam, or an electron beam, and is rapidly cooled by self-cooling to form a chill hardened layer (for example, cf. Japanese Unexamined Patent Publication (Kokai) Nos. 59-23156, 60-234168, and 60-234169 filed by the present applicant). In a production process of a remelted and chilled camshaft using such surface hardening treatment in the prior art, a plurality (two) of tungsten torches are used and a plurality (two) of cams are simultaneously treated at one step station. In this case, since the distance between the tungsten torches is more than 80 mm, even if a plurality (two) of arcs are simultaneously generated, the problem of magnetic arc blow (the phenomenon of disturbance of the arcs by the influence of magnetic fields generated by electric currents) is not serious.

Improvements in the designs of engines have led to a shortening of the distance between cams of a camshaft, and accordingly, the distance between torches is shortened. Therefore, if two arcs are simultaneously generated, they mutually interact and a magnetic arc blow is caused. For example, from experiments made by the present inventors, it was found that when arcs are generated at a torch distance of 28 mm by continuous application of a direct current of 100 A, a deviation of about 0.7 mm is brought about by magnetic arc blow. In the case of a pulsed arc, which has a better arc stiffness than a continuous arc, the torch distance is 23 mm and thus the deviation by magnetic arc blow is about 0.7 mm. When such a magnetic arc blow occurs, the portion melted by TIG arc on the sliding cam surface is deviated from the predetermined position and, as is seen from the cam section shown in FIG. 1, the end face portion 3 of the remelted and chilled layer 2 of the cam 1 sags or an unhardened surface portion 4 appears, with the result that an appropriate hardened surface sliding on a mating member (for example, a rocker arm) cannot be obtained. Note, reference numeral 5 in FIG. 1 represents a hardened layer of a heat-affected zone.

For preventing magnetic arc blow, a method can be considered in which a shaft portion corresponding to the intermediate position between two tungsten torches is adopted as a place at which the camshaft is connected to the positive electrode of a welding power source. But, the construction of this shaft position and a connecting member attached thereto is difficult, and if the contact is degraded to even a slight degree, sparks are generated and the shaft portion and the connecting member are damaged. Furthermore, when another cam is treated after the treated cam, the connecting member must be connected to a fresh shaft portion, and this operation is troublesome.

SUMMARY OF THE INVENTION

Accordingly, the development is desired of a sure and simple treatment method in which, even if adjacent cams are remelted and chilled by using TIG arc while bringing the torches close to each other to a small distance at which a magnetic arc blow would be generated in the conventional technique, magnetic arc blow does not occur at all.

It is a primary object of the present invention to provide a process for producing a remelted and chilled camshaft having adjacent cams which are brought close to each other so that the distance between the tungsten torches is almost 30 mm, without the occurrence of sagging of the end face portion of the cam (deviation of the fusing position) caused by magnetic arc blow.

In accordance with the present invention, this and other objects are attained by a process for producing a remelted and chilled camshaft, which comprises the steps of melting a sliding cam surface of the camshaft by TIG arc and forming a chill layer by self-cooling, wherein in order to simultaneously subject at least two cams under the influence of magnetic arc blow to a remelting treatment by using tungsten torches on the cams, respectively, fusing currents applied to the tungsten torches are alternately changed over so that the sliding cam surface of one cam is melted while sliding cam surface of the other cam is in the nonmelted state, and this operation is alternately repeated on the cams.

According to the preparation process of the present invention, since TIG arcs are not simultaneously generated and a melting current is alternately applied to adjacent torches, magnetic arc blow does not occur.

When an arc is alternately generated in adjacent torches, in order to facilitate the start of the melting TIG arc and to maintain the stability of the TIG arc, it is preferred that an electric current such that an influence of a magnetic arc blow to the generated melting TIG arc does not occur, be applied to the other torch to generate a weak arc.

BRIEF DESCRIPTION OF THE DRAWINGS

The present invention will now be described in detail based on experiments including examples of the present invention and comparative examples eith reference to the accompanying drawings, in which.

DESCRIPTION OF THE PREFERRED EMBODIMENT

Figure 2:
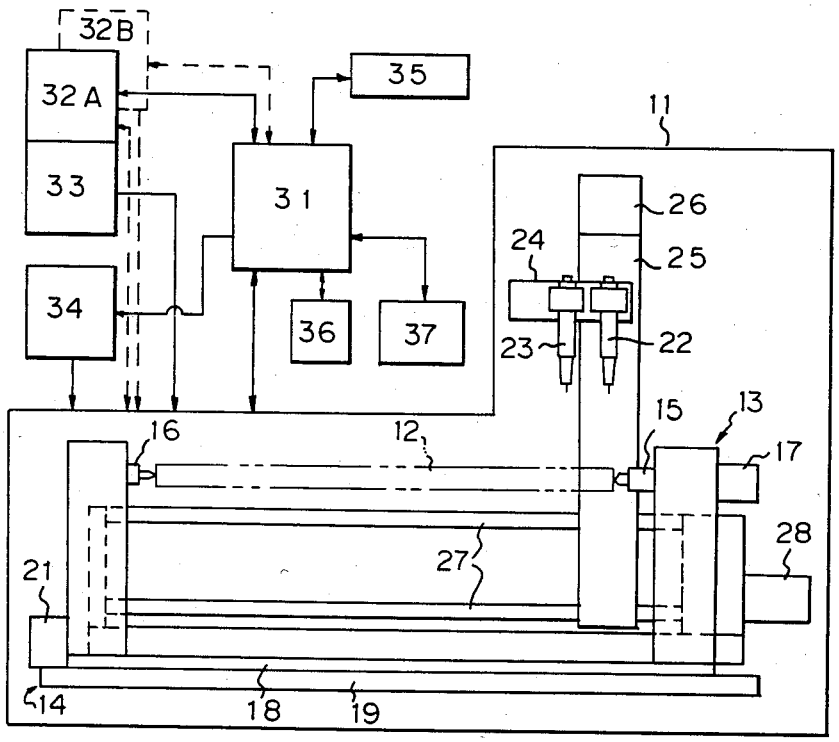
FIG. 2 is a schematic diagram illustrating a TIG arc treatment apparatus provided with two torches.

Referring to FIG. 2, TIG arc treatment apparatus used in the experiments comprises a mechanical apparatus proper 11 and a control unit.

The mechanical apparatus proper 11 comprises rotating portion 13 for holding at a predetermined position and rotating a camshaft (or experimental rod) 12 as a workpiece and an oscillating portion 14 for oscillating (reciprocating) the rotating portion 13. The workpiece 12 is attached between a front center unit 15 and a rear center unit 16 and is rotated by a rotary driver (servomotor) 17. A bottom part 18 of the rotating portion 13 is slidably mounted on a base 19 and the rotating portion 13 is reciprocated by a driver 21. The apparatus proper 11 also comprises a torch driving mechanism disposed independently from the rotating portion 13 and the oscillating portion 14. This driving mechanism comprises a Z-axis slide column 25 and a supporting plate driver 26, which are arranged to move a supporting plate 24 supporting first and second tungsten torches 22 and 23 in the direction of the Z-axis (the direction vertical to the axis of the workpiece), and a slide shaft 27 and a column driver 28, which are arranged to move the Z-axis slide column 25 in the direction of the X-axis (the direction parallel to the axis of the workpiece). In order to adjust the distance between the first and second tungsten torches 22 and 23, the second tungsten torch 23 is slidably attached to the supporting place 24 and the attachment position can be freely set.

The control unit of the TIG arc treatment apparatus comprises a controller 31, a TIG power source 32A, a TIG power source 32B for comparative examples, a current change-over controller 33, an oscillating controller 34, a teaching unit 35, an operating box 36, and a programming unit 37. Certain commands from the controller 31 are transmitted to the rotary driver 17, the supporting plate driver 26, and the column driver 28, and other demands for oscillating the workpiece are transmitted to the driver 21 through the oscillating controller 34. Supply of an electric current to the torches 22 and 23 is effected from the TIG power source 32A through the current change-over controller 33 in the present invention, while electric currents are supplied to two torches 22 and 23 from TIG power sources 32A and 32B, respectively, in comparative examples.

Figure 3:
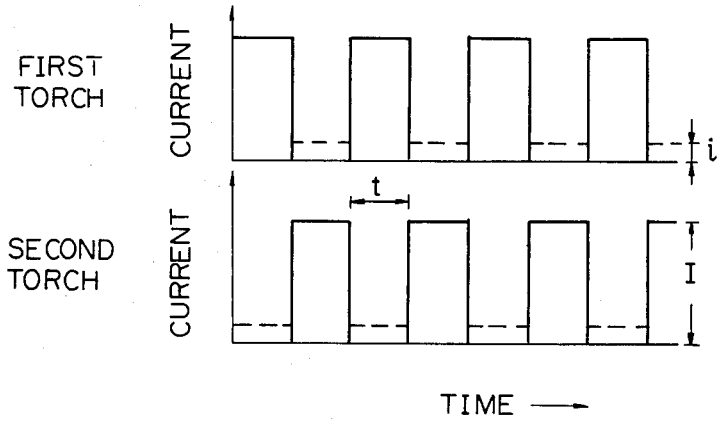
FIG. 3 is a diagram illustrating the wave forms of electric currents supplied to two adjacent torches in the process for producing a remelted and chilled camshaft by using a TIG arc according to the present invention.

When a TIG arc current is supplied to the first and second tungsten torches according to the present invention, current wave forms as shown in FIG. 3 are adopted. When a melting electric current I is supplied to the first torch to generate the TIG arc, no electric current is supplied to the second torch. The melting electric current is supplied to the second torch after the passage of the cycle t, since TIG arcs are not simultaneously generated in the two torches, a magnetic arc blow having an influence on the two torches does not occur. Note, in order to facilitate the start of the TIG melting arc and to maintain the stability thereof, it is preferred that a small current i (indicated by a broken line) of 10 to 30 A, which does not cause magnetic arc blow, be supplied while the melting current is not applied. Furthermore, it is preferred that the cycle t of the melting current be 0.2 to 2.0 seconds.

Experiment 1

Two tungsten torches were brought close to each other (various torch distances were adopted) and a melting TIG arc was generated, and the magnetic arc blow state was examined in the following manner.

Figure 4:
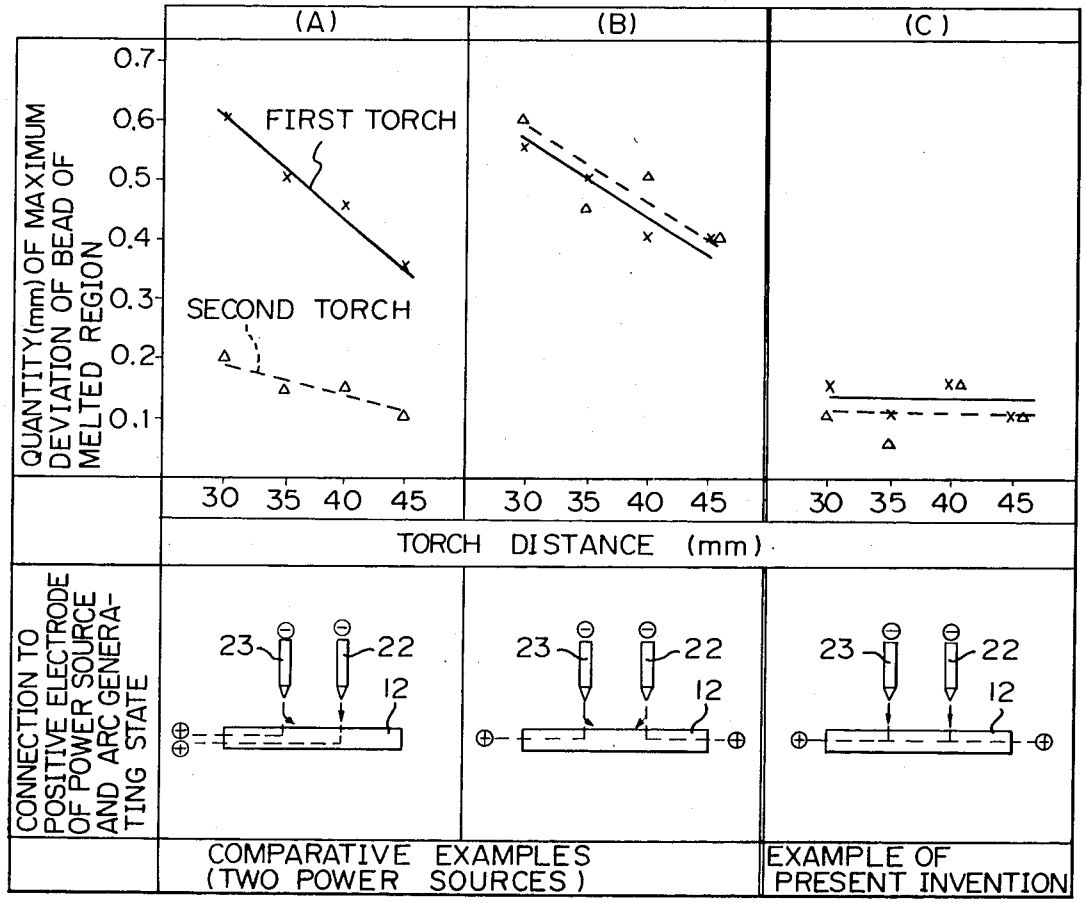
FIG. 4 is a diagram illustrating the relationship between the torch distance and the quantity of deviation of the bead of the region melted by a TIG arc, obtained in the example of the present invention and comparative examples where the magnetic arc blow state was examined at various torch distances.

A test piece 12 consisting of a steel rod (material: S45C, length: 400 mm, diameter: 40 mm) was set at the rotating portion 13 of the above-mentioned TIG arc treatment apparatus. The distance between the first and second tungsten torches 22 and 23 was adjusted to 30 mm, 35 mm, 40 mm or 45 mm. Note, the tops of tungsten electrodes of these torches 22 and 23 were sharpened, and the torch supporting plate 24 was moved on the Z-axis slide column 25 so that both the tungsten electrodes were brought into contact with the test piece. In this state, the test piece 12 was rotated and a marking line (the standard line for measuring the deviation of a bead of the melted region caused by influence of the magnetic arc blow). Then, the supporting plate 24 was moved so that the torches separated from the test piece, and the distance between the tungsten electrodes and the test piece (arc length) was set at 2.0 mm. The test piece 12 was connected to the positive electrode of the TIG power source on one side of the test piece or on both sides of the test piece, and the test piece was arranged as shown in FIG. 4.

After the above-mentioned preparation, in each of the following three cases, a TIG arc was generated with respect to each of the predetermined torch distances, and the quantity of the deviation of the center of the bead of the melted region (i.e., the pass of a chill layer portion) from the marked line was measured. The obtained results are shown in FIG. 4.

CASE A OF FIG. 4 (COMPARATIVE EXAMPLE)

The first tungsten torch 22 was connected to the negative electrode of the TIG power source 32A, and the second tungsten torch 23 was connected to the negative electrode of the TIG power source 32B. The positive electrodes of these TIG power sources 32A and 32B were connected to one end of the test piece (steel rod) 12. Constant melting currents of 100 A were applied to both torches 22 and 23 from the TIG power sources 32A and 32B, respectively, to simultaneously generate arcs in both torches 22 and 23, and the test piece 12 was rotated at a rotation speed of 300°/min, whereby a bead of the melted region was formed on the circumference of the test piece by the TIG arc.

CASE B OF FIG. 4 (COMPARATIVE EXAMPLE)

Arcs were simultaneously generated in both torches 22 and 23 to form a bead of the melted region in the same manner as described in Case A, except that the positive electrode of the TIG power source 32A was connected to one end of the test piece 12 on the side of the first tungsten torch 22 and the positive electrode of the TIG power source was connected to the other end of the test piece 12 on the side of the second tungsten torch 23.

CASE C OF FIG. 3 (EXAMPLE OF PRESENT INVENTION)

Only the TIG power source 32A was used, and the negative electrode of the TIG power source 32A was connected to the first and second tungsten torches 22 and 23 through the current change-over controller 33. The positive electrode of the power source 32A was connected to both ends (or one end) of the test piece 12 directly without the current change-over controller 33. A melting current of 100 A was supplied to the torches, and the wave form of the electric current was controlled by the current change-over controller 33 as shown in FIG. 3, at a one second cycle and arcs were alternately generated in the first and second tungsten torches 22 and 23. At this time, the test piece 12 was rotated at a rotation speed of 200°/min. Note, a current of 20 A was supplied to the torch where a melting TIG arc was not generated. Thus, the bead of the melting region was formed on the circumference of the test piece by the TIG arc.

As seen from the quantity of the deviation of the melted region, shown in FIG. 4, in Comparative Examples (conventional technique), the smaller the distance between the two torches, the larger the influence of magnetic arc blow and the larger the quantity of deviation of the bead of the melting region. Where the torch distance is 30 mm, a deviation of 0.6 mm at largest is formed irrespective of the manner in which the electrodes of the power sources are connected to the test piece. On the other hand, when an electric current is alternately applied to two torches according to the present invention, no substantial deviation of the bead of the melted region is caused and magnetic arc blow is prevented.

EXPERIMENT 2

A camshaft (workpiece) 12 of special cast iron having the following dimensions was subjected to a remelting chilling treatment using the TIG arc treatment apparatus shown in FIG. 2, and the example of the present invention was compared with the comparative example (conventional technique).

Total length of camshaft: 400 mm
Cam width: 10 mm
Distance between cams: 25 mm
Lift height: 9.0 mm This camshaft 12 was set between the center units 15 and 16 of the rotating portion 13. In view of the cam width and the distance between the cams, the distance between the first and second tungsten torches 22 and 23 was set at 35 mm. Furthermore, the arc length between the torches and the camshaft was adjusted to 2.0 mm. In order to melt the cam along the entire cam width, the driver 21 was controlled by the oscillating controller 34 so that the camshaft 12 was oscillated (reciprocated) in the direction of the axis of the camshaft, and the oscillating width was set at 5.5 mm and the cycle was set at 1.0 second. The rotation speed of the camshaft was set at 200°/min in the example of the present invention and at 300°/min in the comparative example. The rotation speed in the example of the present invention was kept low in order to form a continuous chill layer by overlapping beads of the region melted by the TIG arc. In the example of the present invention, two torches (first and second tungsten torches 22 and 23) were connected to the negative electrode of one TIG power source 32A through the current change-over controller 33, and currents having wave forms as shown in FIG. 3 (melting current: 120 A, cycle: 1 second, small current different from melting current: 20 A) were supplied to the torches. The positive electrode of the TIG power source 32A was directly connected to both ends of the camshaft 12. In the comparative example, the two TIG power sources 32A and 32B were used, and the tungsten torches 22 and 23 were connected in the same manner as described in Case B of Experiment 1. A constant melting current of 120 A was applied to each of the torches 22 and 23.

Figure 1:
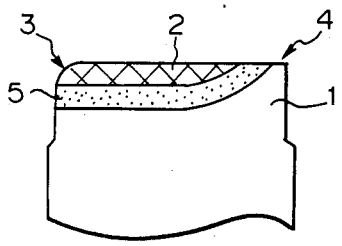
Fig. 1 PRIOR ART
FIG. 1 is a sectional view showing the part of the cam of the camshaft where sagging was caused in the melt formed by a TIG arc in the conventional process.

After the above-mentioned operation, melting TIG arcs were generated on two adjacent surfaces of the camshaft under the conditions of the present invention or the conditions of the comparative example, and the camshaft was oscillated and rotated. Synchronously with this rotation, both torches 22 and 23 were moved in the direction of the Z-axis so as to maintain a predetermined distance between the cam surface and the torches 22 and 23. Thus, the cam surface was melted and a chill layer was formed by self-cooling. The oscillating width was set at 5.5 mm because the cam was melted along the entire cam width (10.0 mm) by the TIG arc by the single tungsten torch without magnetic arc blow. This value is a critical value at which, if magnetic arc blow is generated even to a slight degree, sagging is caused on the end face portion of the cam. In the example of the present invention, the remelting and chilling treatment could be performed with a high precision without sagging on the end face portion of the cam. On the other hand, in the comparative example, sagging was caused in end face portions of the confronting surfaces of the adjacent cams as shown in FIG. 1, and the deviation of bead of the melted region was 0.6 mm at largest.

In the chill layer formed according to the present invention, the surface irregularity was 0.15 mm at largest and no remaining skin portion was left on the cam surface after grinding. Furthermore, while a melting TIG arc was not generated, solidification of the previously formed region could reduce sagging of the melt caused by the force of gravity, and a high-quality chill layer surface (that is, a high-quality cam surface) could be obtained.

According to the present invention, even if adjacent cams of a camshaft are very close to each other, a simultaneous remelting and chilling treatment can be performed by using two tungsten torches without magnetic arc blow by a TIG arc, and a high-quality remelted chilled camshaft can be produced.

It will be obvious that the present invention is not restricted to the above-mentioned embodiments and that many variations are possible for persons skilled in the art without departing from the scope of the invention.

We claim:

1. A process for producing a remelted and chilled camshaft with cams, which comprises the steps of melting a sliding cam surface of the camshaft by TIG arc and forming a chill layer by self-cooling, wherein in order to substantially simultaneously subject two adjacent cams which are mutually spaced by a distance of less than 45 mm from each other to a remelting treatment by using tungsten torches for the cams, respectively, a melting current is applied to one tungsten torch for one cam to melt the sliding cam surface thereof, and simultaneously, a nonmelting current of 10–30A is applied to the other tungsten torch for the other cam without producing magnetic arc blow influence on the TIG arc generated at the tungsten torch, and said current applications are alternately repeated on said cams.

2. A process according to claim 1, wherein said distance between the cams is less than 35 mm.

* * * * *